US011420256B2

(12) United States Patent
Michiaki et al.

(10) Patent No.: US 11,420,256 B2
(45) Date of Patent: Aug. 23, 2022

(54) SILVER POWDER AND METHOD FOR PRODUCING SAME

(71) Applicant: DOWA ELECTRONICS MATERIALS CO., LTD., Tokyo (JP)

(72) Inventors: Yoshiyuki Michiaki, Tokyo (JP); Masahiro Yoshida, Tokyo (JP); Kenichi Inoue, Tokyo (JP)

(73) Assignee: DOWA ELECTRONICS MATERIALS CO., LTD., Tokyo (JP)

( * ) Notice: Subject to any disclaimer, the term of this patent is extended or adjusted under 35 U.S.C. 154(b) by 81 days.

(21) Appl. No.: 16/648,423

(22) PCT Filed: Sep. 18, 2018

(86) PCT No.: PCT/JP2018/034336
§ 371 (c)(1),
(2) Date: Mar. 18, 2020

(87) PCT Pub. No.: WO2019/065341
PCT Pub. Date: Apr. 4, 2019

(65) Prior Publication Data

US 2020/0238388 A1 Jul. 30, 2020

(30) Foreign Application Priority Data

Sep. 29, 2017 (JP) ..... 2017-189319
Aug. 31, 2018 (JP) ..... 2018-162411

(51) Int. Cl.
*B22F 1/10* (2022.01)
*B22F 9/08* (2006.01)
(Continued)

(52) U.S. Cl.
CPC ..... *B22F 9/08* (2013.01); *B22F 1/05* (2022.01); *C22C 5/08* (2013.01);
(Continued)

(58) Field of Classification Search
None
See application file for complete search history.

(56) References Cited

U.S. PATENT DOCUMENTS 4,456,474 A * 6/1984 Jost ..... C22B 11/04 75/371
6,290,749 B1 * 9/2001 White ..... C22B 3/44 75/721
(Continued)

FOREIGN PATENT DOCUMENTS

EP 3357608 A1 * 8/2018
JP 2009235474 A 10/2009
(Continued)

OTHER PUBLICATIONS

Sinha, A. et al., "Preparation of silver powder through glycerol process". Bulletin of Materials Science, vol. 28, No. 3, pp. 213-217, Jun. 2005.*
(Continued)

*Primary Examiner* — George Wyszomierski
(74) *Attorney, Agent, or Firm* — Bachman & LaPointe, P.C.

(57) ABSTRACT

A silver powder which has a small content of carbon and which is difficult to be agglutinated, and a method for producing the same. While a molten metal, which is prepared by melting silver to which 40 ppm or more of copper is added, is allowed to drop, a high-pressure water is sprayed onto the molten metal to rapidly cool and solidify the molten metal to produce a silver powder which contains 40 ppm or more of copper, 0.1% by weight or less of carbon and 0.1% by weight or less of oxygen and wherein the particle diameter (D50 diameter) corresponding to 50% of accumulation in volume-based cumulative distribution of the silver powder, which is measured by means of a laser diffraction particle size analyzer, is in the range of from 1 μm to 15 μm,
(Continued)

the average particle diameter (SEM diameter) of single particles being in the range of from 1 μm to 8 μm when it is measured by means of a field emission scanning electron microscope (SEM), the ratio (SEM diameter/D50 diameter) of the SEM diameter to the D50 diameter being in the range of from 0.3 to 1.0.

8 Claims, 3 Drawing Sheets

(51) Int. Cl.
*B22F 1/05* (2022.01)
*C22C 5/08* (2006.01)
*C23C 2/28* (2006.01)

(52) U.S. Cl.
CPC ... *B22F 2009/0804* (2013.01); *B22F 2301/10* (2013.01); *B22F 2301/255* (2013.01); *B22F 2304/10* (2013.01); *C23C 2/28* (2013.01)

(56) References Cited

U.S. PATENT DOCUMENTS

2011/0253949 A1* 10/2011 Kaneda ..... B22F 9/24
252/514
2018/0272425 A1* 9/2018 Nogami ..... H01B 1/02

FOREIGN PATENT DOCUMENTS

JP 2013014790 A 1/2013
JP 2017082327 B2 5/2017
JP 2017172043 A 9/2017

OTHER PUBLICATIONS

Supplementary European search report for patent application No. 18 863 425.7 dated Feb. 26, 2021.

* cited by examiner

SILVER POWDER AND METHOD FOR PRODUCING SAME

TECHNICAL FIELD

The present invention relates generally to a silver powder and a method for producing the same. More specifically, the invention relates to a silver powder which can be suitably used as the material of an electrically conductive paste, and a method for producing the same.

BACKGROUND ART

Conventionally, metal powders, such as silver powders, are used as the material of an electrically conductive paste for forming electrodes of solar cells, internal electrodes of laminated ceramic electronic parts, such as electronic parts using low-temperature co-fired ceramics (LTCC) and multilayer ceramic inductors (MLCI), external electrodes of laminated ceramic capacitors and/or inductors, and so forth.

As a method for producing a silver powder used as the material of such an electrically conductive paste, there is proposed a method for producing a silver powder by depositing silver particles by reduction by adding a reducing agent to a water reaction system, which contains silver ions, in the presence of seed particles, such as copper particles (see, e.g., Patent Document 1).

There is also proposed a method for producing a silver powder by depositing silver particles by reduction by adding a reducing agent to an aqueous silver solution, such as a silver nitrate, after adding a dispersing agent, such as a stearate, thereto (see, e.g., Patent Document 2).

PRIOR ART DOCUMENT(S)

Patent Document(s)

Patent Document 1: Japanese Patent Laid-Open No. 2009-235474 (Paragraph Numbers 0012-0014)

Patent Document 2: Japanese Patent Laid-Open No. 2013-14790 (Paragraph Numbers 0023-0027)

SUMMARY OF THE INVENTION

Problem to be Solved by the Invention

However, in a method for producing a silver powder by a wet reducing method, such as a method for producing a silver powder described in Patent Documents 1-2, carbon containing compounds serving as impurities are incorporated into the interior of the particles of the silver powder during the production thereof. For that reason, if the silver powder produced by such a method is used as the material of a baked type electrically conductive paste which is applied on a substrate to be burned to form an electrically conductive film, there is a problem in that gases of carbon dioxide or the like are produced from carbon contents during burning, so that the produced gas causes cracks in the electrically conductive film to deteriorate the adhesion of the electrically conductive film to the substrate.

In order to solve such a problem, as a method for inexpensively producing a silver powder having a very low content of impurities such as carbon, there is known a method for producing a silver powder by a so-called water atomizing method for rapidly cooling and solidifying a molten metal of silver, which is prepared by melting silver, by spraying a high-pressure water onto the molten metal while allowing the molten metal to drop.

However, a silver powder produced by a method for producing a silver powder by a conventional water atomizing method is easy to be agglutinated to have large secondary particle diameters. If such an agglutinated silver powder is used as the material of an electrically conductive paste, it is difficult to form a thin electrically conductive film having a flat surface.

Particularly in recent years, it is desired to decrease the particle diameters of a silver powder for use in an electrically conductive paste in order to miniaturize internal electrodes of electronic parts, such as multilayer ceramic inductors (MLCI), and so forth. However, if the particle diameters of the silver powder are decreased, the silver powder is easy to be agglutinated.

It is therefore an object of the present invention to eliminate the aforementioned conventional problems and to provide a silver powder which has a small content of carbon and which is difficult to be agglutinated, and a method for producing the same.

Means for Solving the Problem

In order to accomplish the aforementioned object, the inventors have diligently studied and found that it is possible to produce a silver powder which has a small content of carbon and which is difficult to be agglutinated, if a silver powder, which has a copper content of not less than 40 ppm and a carbon content of not higher than 0.1% by weight, is produced by rapidly cooling and solidifying a molten metal of silver, which contains 40 ppm or more of copper, by spraying a high-pressure water onto the molten metal while allowing the molten metal to drop. Thus, the inventors have made the present invention.

According to the present invention, there is provided a silver powder which has a copper content of not less than 40 ppm and a carbon content of not higher than 0.1% by weight.

The copper content in this silver powder is preferably in the range of from 40 ppm to 10000 ppm. The particle diameter ($D_{50}$ diameter) corresponding to 50% of accumulation in volume-based cumulative distribution of the silver powder, which is measured by means of a laser diffraction particle size analyzer, is preferably in the range of from 1 μm to 15 μm. The ratio (SEM diameter/$D_{50}$ diameter) of an average particle diameter (SEM diameter) of single particles, which is measured by means of a field emission scanning electron microscope, to the particle diameter ($D_{50}$ diameter) corresponding to 50% of accumulation in volume-based cumulative distribution of the silver powder is preferably in the range of from 0.3 to 1.0. The ratio (tap density/$D_{50}$ diameter) of a tap density to the particle diameter ($D_{50}$ diameter) corresponding to 50% of accumulation in volume-based cumulative distribution of the silver powder is preferably in the range of from 0.45 g/(cm$^3$·μm) to 3.0 g/(cm$^3$·μm). The silver powder preferably has an oxygen content of not higher than 0.1% by weight, a BET specific surface area of 0.1 to 1.0 m$^2$/g, and a tap density of 2 to 6 g/cm$^3$.

According to the present invention, there is provided a method for producing a silver powder, the method comprising the steps of: preparing a molten metal of silver containing 40 ppm or more of copper; and rapidly cooling and solidifying the molten metal by spraying a high-pressure water onto the molten metal while allowing the molten metal to drop. In this method for producing a silver powder, the content of copper in the molten metal is preferably in the range of from 40 ppm to 10000 ppm.

According to the present invention, there is provided an electrically conductive paste comprising: an organic component; and the above-described silver powder, the silver powder being dispersed in the organic component.

According to the present invention, there is provided a method for producing an electrically conductive film, the method comprising the steps of: applying the above-described electrically conductive paste on a substrate; and burning the applied electrically conductive paste to produce an electrically conductive film.

According to the present invention, it is possible to produce a silver powder which has a small content of carbon and which is difficult to be agglutinated.

DETAILED DESCRIPTION

Figure 1:
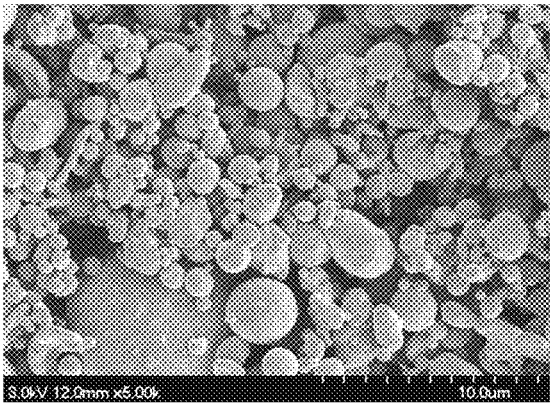
FIG. 1 is a field emission scanning electron microscope (FE-SEM) image of a silver powder, which is obtained in Example 8, when it is observed at a magnification of 5,000.

The preferred embodiment of a silver powder according to the present invention has a copper content of not less than 40 ppm and a carbon content of not higher than 0.1% by weight.

The copper content in the silver powder is not less than 40 ppm (from the points of view of the prevention of agglutination of the silver powder). The copper content in the silver powder is preferably in the range of from 40 ppm to 10000 ppm, more preferably in the range of from 40 ppm to 2000 ppm, still more preferably in the range of from 40 ppm to 800 ppm, and most preferably in the range of from 230 ppm to 750 ppm, from the points of view of the improvement of the resistance to oxidation of the silver powder and the conductivity thereof.

The carbon content in the silver powder is not higher than 0.1% by weight, preferably not higher than 0.03% by weight, and most preferably not higher than 0.007% by weight. If a baked type electrically conductive paste using such a silver powder having a low content of carbon as the material thereof is applied on a substrate to be burned to form an electrically conductive film, the amount of gases of carbon dioxide or the like produced from carbon contents during burning is small, so that it is difficult to cause cracks in the electrically conductive film due to the gases. Thus, it is possible to improve the adhesion of the electrically conductive film to the substrate.

The content of oxygen in the silver powder is preferably 0.1% by weight or less, and more preferably in the range of from 0.01% by weight to 0.07% by weight. If the content of oxygen in the silver powder is thus low, it is possible to sufficiently sinter silver to form an electrically conductive film having high conductivity.

The particle diameter ($D_{50}$ diameter) corresponding to 50% of accumulation in volume-based cumulative distribution of the silver powder, which is measured by means of a laser diffraction particle size analyzer (by HELOS method), is preferably in the range of from 1 μm to 15 μm. When the silver powder is used as the material of an electrically conductive paste for forming internal electrodes of smaller electronic parts and so forth, the particle diameter ($D_{50}$ diameter) corresponding to 50% of accumulation in volume-based cumulative distribution of the silver powder is more preferably in the range of from 1 g m to 8 μm, and most preferably in the range of from 1.2 g m to 7 μm. The average particle diameter (SEM diameter) of single particles, which is measured by means of a field emission scanning electron microscope (SEM), is preferably in the range of from 1 μm to 8 μm, more preferably in the range of from 1 μm to 5 μm, and most preferably in the range of from 1.2 μm to 4 μm, when the silver powder is used as the material of an electrically conductive paste for forming internal electrodes of smaller electronic parts and so forth. The ratio (SEM diameter/$D_{50}$ diameter) of the average particle diameter (SEM diameter) of the single particles, which is measured by means of a field emission scanning electron microscope, to the particle diameter ($D_{50}$ diameter) corresponding to 50% of accumulation in volume-based cumulative distribution of the silver powder is preferably in the range of from 0.3 to 1.0, more preferably 0.35 to 1.0, still more preferably 0.5 to 1.0, and most preferably 0.65 to 1.0. If this ratio (SEM diameter/$D_{50}$ diameter) (primary particle diameter/secondary particle diameter) is higher, the agglutination of the silver powder is smaller.

The BET specific surface area of the silver powder is preferably 0.1 to 1.0 $m^2/g$, more preferably 0.2 to 0.8 $m^2/g$, and most preferably 0.3 to 0.5 $m^2/g$. The tap density of the silver powder is preferably 2 to 6 $g/cm^3$, more preferably 2.5 to 5.5 $g/cm^3$, and most preferably 3.5 to 5.5 $g/cm^3$, in order to form an electrically conductive film having good conductivity by enhancing the density of the silver powder when the silver powder is used as the material of an electrically conductive paste to form the electrically conductive film. Moreover, in order to form an electrically conductive film having good conductivity by enhancing the density of the silver powder when the silver powder is used as the material of an electrically conductive paste to form the electrically conductive film, the ratio (tap density/$D_{50}$ diameter) of the tap density to the particle diameter ($D_{50}$ diameter) corresponding to 50% of accumulation in volume-based cumulative distribution of the silver powder is preferably in the range of from 0.45 $g/(cm^3 \cdot \mu m)$ to 3.0 $g/(cm^3 \cdot \mu m)$, more preferably 0.8 $g/(cm^3 \cdot \mu m)$ to 2.8 $g/(cm^3 \cdot \mu m)$, and most preferably 1.1 $g/(cm^3 \cdot \mu m)$ to 2.5 $g/(cm^3 \cdot \mu m)$.

Furthermore, the shape of the silver powder may be any one of various granular shapes, such as spherical shapes or flake shapes, and indefinite shapes which are irregular shapes.

The above-described preferred embodiment of the silver powder can be produced by the preferred embodiment of a method for producing a silver powder according to the present invention.

In the preferred embodiment of a method for producing a silver powder according to the present invention, a molten metal of silver, which is prepared by adding 40 ppm or more (preferably 40 to 10000 ppm, more preferably 40 to 2000 ppm, still more preferably 40 to 800 ppm and most preferably 230 to 750 ppm) of copper (preferably in the form of simple copper or an Ag—Cu alloy) to silver to melt the mixture (preferably at a temperature which is higher than the melting point (about 962° C.) of silver by 300 to 720° C.), is rapidly cooled and solidified by spraying a high-pressure water (which is pure water or alkaline water having a pH of 8 to 12) onto the molten metal (preferably at a water pressure of 70 to 400 MPa (more preferably at a water pressure of 90 to 280 MPa) in the atmosphere or in a non-oxidative atmosphere (of hydrogen, carbon monoxide, argon, nitrogen or the like)) while allowing the molten metal to drop.

If the silver powder is produced from a molten metal, which is prepared by adding a small amount (40 ppm or more, preferably 40 to 10000 ppm, more preferably 40 to 2000 ppm, still more preferably 40 to 800 ppm and most preferably 230 to 750 ppm) of copper to silver, by the so-called water atomizing method for spraying a high-pressure water onto the molten metal, it is possible to obtain a silver powder which has a small particle diameter and a small content of carbon and which is difficult to be agglutinated.

The average particle diameter of the silver powder can be adjusted by controlling the temperature of the molten metal and the pressure of the high-pressure water when the silver powder is produced from the molten metal by the water atomizing method. For example, the average particle diameter of the silver powder can be decreased by increasing the temperature of the molten metal and the pressure of the high-pressure water.

When the silver powder is produced from the molten metal by the water atomizing method, the solid-liquid separation of a slurry, which is obtained by rapidly cooling and solidifying the molten metal by spraying the high-pressure water onto the molten metal while allowing the molten metal to drop, can be carried out to obtain a solid body which is dried to obtain a silver powder. Furthermore, if necessary, the solid body obtained by the solid-liquid separation may be washed with water before it is dried, and the solid body may be pulverized and/or classified to adjust the particle size thereof after it is dried.

When the preferred embodiment of a silver powder according to the present invention is used as the material of an electrically conductive paste (such as a baked type electrically conductive paste), the electrically conductive paste can be produced by dispersing the silver powder in an organic component, such as an organic solvent (such as saturated aliphatic hydrocarbons, unsaturated aliphatic hydrocarbons, ketones, aromatic hydrocarbons, glycol ethers, esters, and alcohols) and a binder resin (such as ethyl cellulose or acrylic resins). If necessary, the electrically conductive paste may contain glass frits, inorganic oxides, dispersing agents, and so forth.

The content of the silver powder in the electrically conductive paste is preferably 5 to 98% by weight and more preferably 70 to 95% by weight, from the points of view of the producing costs of the electrically conductive paste and the conductivity of the electrically conductive film. The silver powder in the electrically conductive paste may be mixed with one or more of other metal powders (such as an alloy powder of silver and tin, and/or tin powder) to be used. The metal powder(s) may have different shapes and particle diameters from those of the preferred embodiment of a silver powder according to the present invention. The particle diameter ($D_{50}$ diameter) corresponding to 50% of accumulation in volume-based cumulative distribution of the metal powder (s), which is measured by means of a laser diffraction particle size analyzer, is preferably 0.5 to 20 μm in order to burn the electrically conductive paste to form a thin electrically conductive film. The content of the metal powder(s) in the electrically conductive paste is preferably 1 to 94% by weight and more preferably 4 to 29% by weight. Furthermore, the total of the contents of the silver powder and the metal powder (s) in the electrically conductive paste is preferably 60 to 99% by weight. The content of the organic solvent in the electrically conductive paste is preferably 0.8 to 20% by weight and more preferably 0.8 to 15% by weight, from the points of view of the dispersibility of the silver powder in the electrically conductive paste and of the reasonable viscosity of the electrically conductive paste. Two or more of the organic solvents may be mixed to be used. The content of the binder resin in the electrically conductive paste is preferably 0.1 to 10% by weight and more preferably 0.1 to 6% by weight, from the points of view of the dispersibility of the silver powder in the electrically conductive paste and of the conductivity of the electrically conductive paste. Two or more of the binder resins may be mixed to be used. The content of the glass frit in the electrically conductive paste is preferably 0.1 to 20% by weight and more preferably 0.1 to 10% by weight, from the points of view of the sinterability of the electrically conductive paste. Two or more of the glass frits may be mixed to be used.

For example, such an electrically conductive paste can be prepared by putting components, the weights of which are measured, in a predetermined vessel to preliminarily knead the components by means of a Raikai mixer (grinder), an all-purpose mixer, a kneader or the like, and thereafter, kneading them by means of a three-roll mill. Thereafter, an organic solvent may be added thereto to adjust the viscosity thereof, if necessary. The glass frit, inorganic oxide, organic solvent and/or binder resin may be kneaded to decrease the fineness of grind thereof, and then, the silver powder may be finally added to be kneaded.

If this electrically conductive paste is burned after it is applied on a substrate (such as a ceramic substrate or dielectric layer) so as to have a predetermined pattern shape by dipping or printing (such as metal mask printing, screen printing, or ink-jet printing), an electrically conductive film can be formed. When the electrically conductive paste is applied by dipping, if a substrate is dipped into the electrically conductive paste to form a coating film to remove unnecessary portions of an electrically conductive film which is obtained by burning the coating film, it is possible to cause the electrically conductive film, which is formed on the substrate, to have a predetermined pattern shape.

Although the burning of the electrically conductive paste applied on the substrate may be carried out in a non-oxidative atmosphere (such as an atmosphere of nitrogen, argon, hydrogen or carbon monoxide), it is preferably carried out in the atmosphere in view of the producing costs thereof since the silver powder is difficult to be oxidized. Furthermore, the burning temperature of the electrically conductive paste is preferably about 600 to 1000° C., and more preferably about 700 to 900° C. Before the burning of the electrically conductive paste, volatile constituents, such as organic solvents, in the electrically conductive paste may be removed by pre-drying by vacuum drying or the like. When the electrically conductive paste contains the binder resin, it is preferably heated at a low temperature of 250 to 400° C. as a debinding step for decreasing the content of the binder resin, before being burned.

EXAMPLES

Examples of a silver powder and a method for producing the same according to the present invention will be described below in detail.

Example 1

While a molten metal (a molten metal of silver containing 46 ppm of copper) prepared by melting by heating 23.96 kg of shot silver having a purity of 99.99% by weight and 6.04 kg of an Ag—Cu alloy (containing 228 ppm of copper) to 1600° C. in the atmosphere was allowed to drop from the lower portion of a tundish, an alkaline water (an aqueous alkaline solution (pH10.7) prepared by adding 157.55 g of sodium hydroxide to 21.6 $m^3$ of pure water) was sprayed onto the molten metal at a water pressure of 150 MPa and a water flow rate of 160 L/min. in the atmosphere by means of a water atomizing apparatus to rapidly cool and solidify the molten metal to obtain a slurry. The solid-liquid separation of the slurry thus obtained was carried out to obtain a solid body. The solid body thus obtained was washed with water, and dried to obtain a silver powder (containing a small amount of copper).

As the single particle diameter (primary particle diameter) of the silver powder thus obtained, the average particle diameter (SEM diameter) of single particles, which were observed at a magnification of 5,000 by means of a field emission scanning electron microscope (SEM) (S-4700 produced by Hitachi High-Technologies Corporation), was obtained from the average values of Feret diameters of optional 30 particles. As a result, the SEM diameter (primary particle diameter) of the silver powder was 2.35 μm. As the agglutinated particle diameter (secondary particle diameter) of the silver powder, the particle diameter ($D_{50}$ diameter) corresponding to 50% of accumulation in volume-based cumulative distribution of the silver powder was measured at a dispersing pressure of 5 bar by means of a laser diffraction particle size analyzer (HELOS particle size analyzer produced by SYMPATEC GmbH (HELOS & RODOS (dry dispersion in the free aerosol jet))). Asa result, the particle diameter ($D_{50}$ diameter) corresponding to 50% of accumulation in volume-based cumulative distribution of the silver powder was 6.0 μm. Furthermore, the ratio (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder was calculated to be 0.39.

The composition analysis of the silver powder was carried out by means of an inductively coupled plasma (ICP) emission analyzer (SPS3520V produced by Hitachi High-Tech Science Corporation). As a result, the content of copper in the silver powder was within the range of ±10% of the content of copper in the molten metal.

The content of carbon in the silver powder was measured by means of a carbon/sulfur analyzer (EMIA-920V2 produced by HORIBA, Ltd.). Asa result, the content of carbon in the silver powder was 0.004% by weight. The content of oxygen in the silver powder was measured by means of an oxygen/nitrogen/hydrogen analyzer (EMGA-920 produced by HORIBA, Ltd.). As a result, the content of oxygen in the silver powder was 0.040% by weight.

The BET specific surface area of the silver powder was measured by means of a BET specific surface area measuring apparatus (Macsorb produced by Mountech Co., Ltd.) using the single point BET method, while a mixed gas of nitrogen and helium ($N_2$: 30% by volume, He: 70% by volume) was caused to flow in the apparatus after nitrogen gas was caused to flow in the apparatus at 105° C. for 20 minutes to deaerate the interior of the apparatus. As a result, the BET specific surface area of the silver powder was 0.34 $m^2/g$.

As the tap density (TAP) of the silver powder, the density of the silver powder was obtained by the same method as that disclosed in Japanese Laid-Open No. 2007-263860 as follows. First, a closed-end cylindrical die having a size of an inside diameter of 6 mm×a height of 11.9 mm was used for filling 80% of the volume thereof with the silver powder to form a silver powder layer. Then, a pressure of 0.160 $N/m^2$ was uniformly applied on the top face of the silver powder layer to compress the silver powder until it was not able to be more densely filled with the silver powder at this pressure, and thereafter, the height of the silver powder layer was measured. Then, the density of the silver powder was obtained from the measured height of the silver powder layer and the weight of the filled silver powder. As a result, the tap density of the silver powder was 3.0 $g/cm^3$. Furthermore, the ratio (TAP/$D_{50}$ diameter) of the tap density (TAP) to the particle diameter ($D_{50}$ diameter) corresponding to 50% of accumulation in volume-based cumulative distribution of the silver powder was calculated to be 0.50 $g/(cm^3 \cdot \mu m)$.

Example 2

A silver powder (containing a small amount of copper) was obtained by the same method as that in Example 1, except that a molten metal (a molten metal of silver containing 218 ppm of copper) prepared by melting 25 kg of shot silver and 15 kg of an Ag—Cu alloy (containing 581 ppm of copper) was used.

With respect to the silver powder thus obtained, the SEM diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 2.34 μm, and the particle diameter ($D_{50}$ diameter) corresponding to 50% of accumulation in volume-based cumulative distribution of the silver powder was 4.1 μm. The ratio (SEM diameter/$D_{50}$ diameter) (primary particle diameter/secondary particle diameter) was 0.57.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the content of copper in the silver powder was within the range of ±10% of the content of copper in the molten metal. The content of carbon in the silver powder was 0.002% by weight, and the content of oxygen in the silver powder was 0.041% by weight. The BET specific surface area was 0.36 $m^2/g$, and the tap density was 4.1 g/cm$^3$. The ratio (TAP/$D_{50}$ diameter) of the tap density (TAP) to the particle diameter ($D_{50}$ diameter) corresponding to 50% of accumulation in volume-based cumulative distribution of the silver powder was 1.00 g/(cm$^3$·μm).

Example 3

A silver powder (containing a small amount of copper) was obtained by the same method as that in Example 1, except that a molten metal (a molten metal of silver containing 238 ppm of copper) prepared by melting 24 kg of shot silver and 16 kg of an Ag—Cu alloy (containing 595 ppm of copper) was used.

With respect to the silver powder thus obtained, the SEM diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 2.19 μm, and the particle diameter ($D_{50}$ diameter) corresponding to 50% of accumulation in volume-based cumulative distribution of the silver powder was 2.9 μm. The ratio (SEM diameter/$D_{50}$ diameter) (primary particle diameter/secondary particle diameter) was 0.75.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the content of copper in the silver powder was within the range of ±10% of the content of copper in the molten metal. The content of carbon in the silver powder was 0.004% by weight, and the content of oxygen in the silver powder was 0.051% by weight. The BET specific surface area was 0.42 m$^2$/g, and the tap density was 4.2 g/cm$^3$. The ratio (TAP/$D_{50}$ diameter) of the tap density (TAP) to the particle diameter ($D_{50}$ diameter) corresponding to 50% of accumulation in volume-based cumulative distribution of the silver powder was 1.45 g/(cm$^3$·μm).

Example 4

A silver powder (containing a small amount of copper) was obtained by the same method as that in Example 1, except that a molten metal (a molten metal of silver containing 253 ppm of copper) prepared by melting 25 kg of shot silver and 15 kg of an Ag—Cu alloy (containing 675 ppm of copper) was used.

With respect to the silver powder thus obtained, the diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 2.51 μm, and the particle diameter ($D_{50}$ diameter) corresponding to 50% of accumulation in volume-based cumulative distribution of the silver powder was 3.1 μm. The ratio (SEM diameter/$D_{50}$ diameter) (primary particle diameter/secondary particle diameter) was 0.81.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the content of copper in the silver powder was within the range of ±10% of the content of copper in the molten metal. The content of carbon in the silver powder was 0.003% by weight, and the content of oxygen in the silver powder was 0.036% by weight. The BET specific surface area was 0.36 m$^2$/g, and the tap density was 5.0 g/cm$^3$. The ratio (TAP/$D_{50}$ diameter) of the tap density (TAP) to the particle diameter ($D_{50}$ diameter) corresponding to 50% of accumulation in volume-based cumulative distribution of the silver powder was 1.61 g/(cm$^3$·μm).

Example 5

A silver powder (containing a small amount of copper) was obtained by the same method as that in Example 1, except that a molten metal (a molten metal of silver containing 370 ppm of copper) prepared by melting 18.62 kg of shot silver and 11.38 kg of an Ag—Cu alloy (containing 975 ppm of copper) was used.

With respect to the silver powder thus obtained, the SEM diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 2.54 μm, and the particle diameter ($D_{50}$ diameter) corresponding to 50% of accumulation in volume-based cumulative distribution of the silver powder was 2.8 μm. The ratio (SEM diameter/$D_{50}$ diameter) (primary particle diameter/secondary particle diameter) was 0.90.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the content of copper in the silver powder was within the range of ±10% of the content of copper in the molten metal. The content of carbon in the silver powder was 0.004% by weight, and the content of oxygen in the silver powder was 0.049% by weight. The BET specific surface area was 0.37 $m^2/g$, and the tap density was 4.7 $g/cm^3$. The ratio (TAP/$D_{50}$ diameter) of the tap density (TAP) to the particle diameter ($D_{50}$ diameter) corresponding to 50% of accumulation in volume-based cumulative distribution of the silver powder was 1.68 $g/(cm^3 \cdot \mu m)$.

Example 6

A silver powder (containing a small amount of copper) was obtained by the same method as that in Example 1, except that a molten metal (a molten metal of silver containing 375 ppm of copper) prepared by melting 6.27 kg of shot silver and 2.43 kg of an Ag—Cu alloy (containing 1343 ppm of copper) was used.

With respect to the silver powder thus obtained, the SEM diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 2.83 μm, and the particle diameter ($D_{50}$ diameter) corresponding to 50% of accumulation in volume-based cumulative distribution of the silver powder was 3.1 μm. The ratio (SEM diameter/$D_{50}$ diameter) (primary particle diameter/secondary particle diameter) was 0.91.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the content of copper in the silver powder was within the range of ±10% of the content of copper in the molten metal. The content of carbon in the silver powder was 0.006% by weight, and the content of oxygen in the silver powder was 0.069% by weight. The BET specific surface area was 0.35 $m^2/g$, and the tap density was 4.7 $g/cm^3$. The ratio (TAP/$D_{50}$ diameter) of the tap density (TAP) to the particle diameter ($D_{50}$ diameter) corresponding to 50% of accumulation in volume-based cumulative distribution of the silver powder was 1.52 $g/(cm^3 \cdot \mu m)$.

Example 7

A silver powder (containing a small amount of copper) was obtained by the same method as that in Example 1, except that a molten metal (a molten metal of silver containing 385 ppm of copper) prepared by melting 29.79 kg of shot silver and 10.21 kg of an Ag—Cu alloy (containing 1508 ppm of copper) was used.

With respect to the silver powder thus obtained, the SEM diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 2.57 μm, and the particle diameter ($D_{50}$ diameter) corresponding to 50% of accumulation in volume-based cumulative distribution of the silver powder was 2.9 μm. The ratio (SEM diameter/$D_{50}$ diameter) (primary particle diameter/secondary particle diameter) was 0.89.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the content of copper in the silver powder was within the range of ±10% of the content of copper in the molten metal. The content of carbon in the silver powder was 0.002% by weight, and the content of oxygen in the silver powder was 0.046% by weight. The BET specific surface area was 0.36 $m^2/g$, and the tap density was 4.3 $g/cm^3$. The ratio (TAP/$D_{50}$ diameter) of the tap density (TAP) to the particle diameter ($D_{50}$ diameter) corresponding to 50% of accumulation in volume-based cumulative distribution of the silver powder was 1.48 $g/(cm^3 \cdot \mu m)$.

Example 8

A silver powder (containing 220 ppm of copper) was obtained by the same method as that in Example 1, except that a molten metal (a molten metal of silver containing 218 ppm of copper) prepared by melting 39.97 kg of shot silver and 0.031 kg of an Ag—Cu alloy (containing 28% by weight of copper) was used.

With respect to the silver powder thus obtained, the SEM diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 2.33 μm, and the particle diameter ($D_{50}$ diameter) corresponding to 50% of accumulation in volume-based cumulative distribution of the silver powder was 4.3 μm. The ratio (SEM diameter/$D_{50}$ diameter) (primary particle diameter/secondary particle diameter) was 0.54.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the content of copper in the silver powder was 220 ppm. The content of carbon in the silver powder was 0.005% by weight, and the content of oxygen in the silver powder was 0.046% by weight. The BET specific surface area was 0.34 $m^2/g$, and the tap density was 3.7 $g/cm^3$. The ratio (TAP/$D_{50}$ diameter) of the tap density (TAP) to the particle diameter ($D_{50}$ diameter) corresponding to 50% of accumulation in volume-based cumulative distribution of the silver powder was 0.84 $g/(cm^3 \cdot \mu m)$.

Example 9

A silver powder (containing 270 ppm of copper) was obtained by the same method as that in Example 1, except that a molten metal (a molten metal of silver containing 257 ppm of copper) prepared by melting 31.79 kg of shot silver and 8.21 kg of an Ag—Cu alloy (containing 1252 ppm of copper) was used.

With respect to the silver powder thus obtained, the SEM diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 2.60 μm, and the particle diameter ($D_{50}$ diameter) corresponding to 50% of accumulation in volume-based cumulative distribution of the silver powder was 2.9 μm. The ratio (SEM diameter/$D_{50}$ diameter) (primary particle diameter/secondary particle diameter) was 0.89.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the content of copper in the silver powder was 270 ppm. The content of carbon in the silver powder was 0.001% by weight, and the content of oxygen in the silver powder was 0.042% by weight. The BET specific surface area was 0.37 $m^2/g$, and the tap density was 4.7 $g/cm^3$. The ratio (TAP/$D_{50}$ diameter) of the tap density (TAP) to the particle diameter ($D_{50}$ diameter) corresponding to 50% of accumulation in volume-based cumulative distribution of the silver powder was 1.60 $g/(cm^3 \cdot \mu m)$.

Example 10

A silver powder (containing 310 ppm of copper) was obtained by the same method as that in Example 1, except that a molten metal (a molten metal of silver containing 303 ppm of copper) prepared by melting 48.00 kg of shot silver and 32.00 kg of an Ag—Cu alloy (containing 757 ppm of copper) was used.

With respect to the silver powder thus obtained, the SEM diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 2.73 μm, and the particle diameter ($D_{50}$ diameter) corresponding to 50% of accumulation in volume-based cumulative distribution of the silver powder was 3.6 μm. The ratio (SEM diameter/$D_{50}$ diameter) (primary particle diameter/secondary particle diameter) was 0.76.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the content of copper in the silver powder was 310 ppm. The content of carbon in the silver powder was 0.003% by weight, and the content of oxygen in the silver powder was 0.042% by weight. The BET specific surface area was 0.35 $m^2/g$, and the tap density was 4.1 $g/cm^3$. The ratio (TAP/$D_{50}$ diameter) of the tap density (TAP) to the particle diameter ($D_{50}$ diameter) corresponding to 50% of accumulation in volume-based cumulative distribution of the silver powder was 1.14 $g/(cm^3 \cdot \mu m)$.

Example 11

A silver powder (containing 360 ppm of copper) was obtained by the same method as that in Example 1, except that a molten metal (a molten metal of silver containing 349 ppm of copper) prepared by melting 20.69 kg of shot silver and 19.31 kg of an Ag—Cu alloy (containing 723 ppm of copper) was used.

With respect to the silver powder thus obtained, the SEM diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 3.15 μm, and the particle diameter ($D_{50}$ diameter) corresponding to 50% of accumulation in volume-based cumulative distribution of the silver powder was 3.3 μm. The ratio (SEM diameter/$D_{50}$ diameter) (primary particle diameter/secondary particle diameter) was 0.97.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the content of copper in the silver powder was 360 ppm. The content of carbon in the silver powder was 0.003% by weight, and the content of oxygen in the silver powder was 0.043% by weight. The BET specific surface area was 0.38 $m^2/g$, and the tap density was 3.8 $g/cm^3$. The ratio (TAP/$D_{50}$ diameter)

of the tap density (TAP) to the particle diameter ($D_{50}$ diameter) corresponding to 50% of accumulation in volume-based cumulative distribution of the silver powder was 1.16 g/(cm$^3$·μm).

Example 12

A silver powder (containing 620 ppm of copper) was obtained by the same method as that in Example 1, except that a molten metal (a molten metal of silver containing 560 ppm of copper) prepared by melting 6.00 kg of shot silver and 14.00 kg of an Ag—Cu alloy (containing 800 ppm of copper) was used.

With respect to the silver powder thus obtained, the SEM diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 2.32 μm, and the particle diameter ($D_{50}$ diameter) corresponding to 50% of accumulation in volume-based cumulative distribution of the silver powder was 2.8 μm. The ratio (SEM diameter/$D_{50}$ diameter) (primary particle diameter/secondary particle diameter) was 0.84.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the content of copper in the silver powder was 620 ppm. The content of carbon in the silver powder was 0.003% by weight, and the content of oxygen in the silver powder was 0.057% by weight. The BET specific surface area was 0.38 m$^2$/g, and the tap density was 4.4 g/cm$^3$. The ratio (TAP/$D_{50}$ diameter) of the tap density (TAP) to the particle diameter ($D_{50}$ diameter) corresponding to 50% of accumulation in volume-based cumulative distribution of the silver powder was 1.59 g/(cm$^3$·μm).

Comparative Example

A silver powder was obtained by the same method as that in Example 1, except that a molten metal of silver prepared by melting 5 kg of shot silver was used.

With respect to the silver powder thus obtained, the SEM diameter (primary particle diameter) was calculated, and the particle diameter ($D_{50}$ diameter) (secondary diameter) corresponding to 50% of accumulation in volume-based cumulative distribution of the silver powder was measured to calculate the ratio (SEM diameter/$D_{50}$ diameter) (primary particle diameter/secondary particle diameter) of the SEM diameter (primary particle diameter) to the particle diameter ($D_{50}$ diameter) (secondary particle diameter) corresponding to 50% of accumulation in volume-based cumulative distribution of the silver powder. As a result, the SEM diameter (primary particle diameter) of the silver powder was 2.33 μm, and the particle diameter ($D_{50}$ diameter) corresponding to 50% of accumulation in volume-based cumulative distribution of the silver powder was 9.6 μm. The ratio (SEM diameter/$D_{50}$ diameter) (primary particle diameter/secondary particle diameter) was 0.24.

By the same methods as those in Example 1, the composition analysis of the silver powder was carried out, and the contents of carbon and oxygen in the silver powder were measured. Moreover, the BET specific surface area and tap density (TAP) of the silver powder were obtained, and the ratio (TAP/$D_{50}$ diameter) of the tap density (TAP) to the particle diameter ($D_{50}$ diameter) corresponding to 50% of accumulation in volume-based cumulative distribution of the silver powder was calculated. As a result, the obtained silver powder was a silver powder containing no copper. The content of carbon in the silver powder was 0.004% by weight, and the content of oxygen in the silver powder was 0.038% by weight. The BET specific surface area was 0.35 m$^2$/g, and the tap density was 2.3 g/cm$^3$. The ratio (TAP/$D_{50}$ diameter) of the tap density (TAP) to the particle diameter ($D_{50}$ diameter) corresponding to 50% of accumulation in volume-based cumulative distribution of the silver powder was 0.24 g/(cm$^3$·μm).

Figure 2:
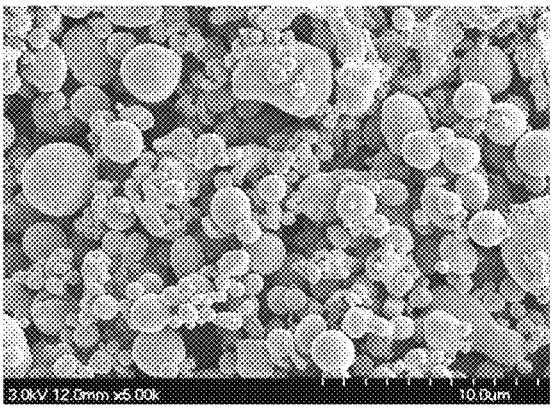
FIG. 2 is an FE-SEM image of a silver powder, which is obtained in Example 9, when it is observed at a magnification of 5,000.
Figure 3:
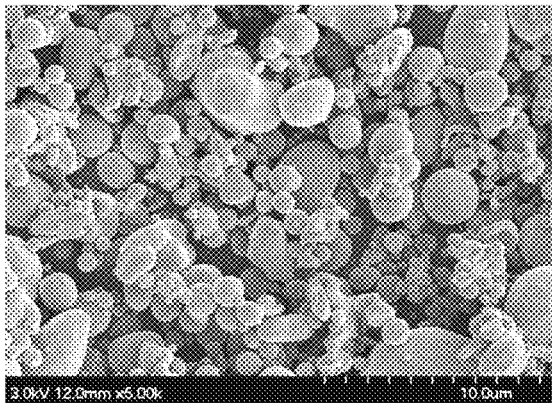
FIG. 3 is an FE-SEM image of a silver powder, which is obtained in Example 10, when it is observed at a magnification of 5,000.
Figure 4:
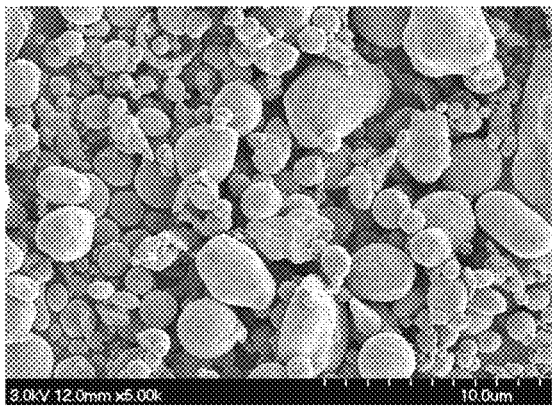
FIG. 4 is an FE-SEM image of a silver powder, which is obtained by Example 11, when it is observed at a magnification of 5,000.
Figure 5:
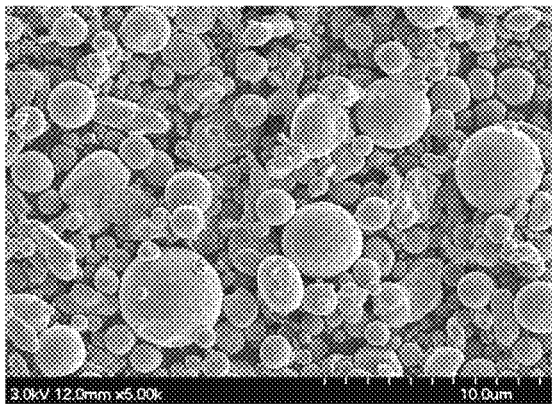
FIG. 5 is an FE-SEM image of a silver powder, which is obtained by Example 12, when it is observed at a magnification of 5,000.

The amounts of copper in the raw materials and characteristics of the silver powders in these examples and comparative example are shown in Tables 1 and 2. FIGS. 1-5 show the field emission scanning electron microscope (FE-SEM) images of the silver powders, which are obtained in Examples 8-12, when the silver powders are observed at a magnification of 5,000.

TABLE 1

| | Cu(Supply Amount) (ppm) | $D_{50}$ Diameter (μm) | SEM Diameter (μm) | SEM Diameter/$D_{50}$ Diameter |
|---|---|---|---|---|
| Ex. 1 | 46 | 6.0 | 2.35 | 0.39 |
| Ex. 2 | 218 | 4.1 | 2.34 | 0.57 |
| Ex. 3 | 238 | 2.9 | 2.19 | 0.75 |
| Ex. 4 | 253 | 3.1 | 2.51 | 0.81 |
| Ex. 5 | 370 | 2.8 | 2.54 | 0.90 |
| Ex. 6 | 375 | 3.1 | 2.83 | 0.91 |
| Ex. 7 | 385 | 2.9 | 2.57 | 0.89 |
| Ex. 8 | 218 | 4.3 | 2.33 | 0.54 |
| Ex. 9 | 257 | 2.9 | 2.60 | 0.89 |
| Ex. 10 | 303 | 3.6 | 2.73 | 0.76 |
| Ex. 11 | 349 | 3.3 | 3.15 | 0.97 |
| Ex. 12 | 560 | 2.8 | 2.32 | 0.84 |
| Comp. | 0 | 9.6 | 2.33 | 0.24 |

TABLE 2

| | C (wt. %) | O (wt. %) | BET (m$^2$/g) | TAP (g/cm$^3$) | TAP/$D_{50}$ Diameter (g/(cm$^3$ · μm)) |
|---|---|---|---|---|---|
| Ex. 1 | 0.004 | 0.040 | 0.34 | 3.0 | 0.50 |
| Ex. 2 | 0.002 | 0.041 | 0.36 | 4.1 | 1.00 |
| Ex. 3 | 0.004 | 0.051 | 0.42 | 4.2 | 1.45 |
| Ex. 4 | 0.003 | 0.036 | 0.36 | 5.0 | 1.61 |
| Ex. 5 | 0.004 | 0.049 | 0.37 | 4.7 | 1.68 |
| Ex. 6 | 0.006 | 0.069 | 0.35 | 4.7 | 1.52 |
| Ex. 7 | 0.002 | 0.046 | 0.36 | 4.3 | 1.48 |
| Ex. 8 | 0.005 | 0.046 | 0.34 | 3.7 | 0.84 |
| Ex. 9 | 0.001 | 0.042 | 0.37 | 4.7 | 1.60 |
| Ex. 10 | 0.003 | 0.042 | 0.35 | 4.1 | 1.14 |
| Ex. 11 | 0.003 | 0.043 | 0.38 | 3.8 | 1.16 |
| Ex. 12 | 0.003 | 0.057 | 0.38 | 4.4 | 1.59 |
| Comp. | 0.004 | 0.038 | 0.35 | 2.3 | 0.24 |

INDUSTRIAL APPLICABILITY

It is possible to obtain an electrically conductive film having high conductivity if a silver powder according to the present invention is utilized as the material of a baked type electrically conductive paste in order to form electrodes of solar cells, internal electrodes of laminated ceramic electronic parts, such as electronic parts using low-temperature co-fired ceramics (LTCC) and laminated ceramic inductors, external electrodes of laminated ceramic capacitors and/or inductors, and so forth.

The invention claimed is:

1. A silver powder which has a copper content of 218 to 10000 ppm and a carbon content of not higher than 0.1% by weight, wherein the particle diameter ($D_{50}$ diameter) corresponding to 50% of accumulation in volume-based cumulative distribution of the silver powder, which is measured by means of a laser diffraction particle size analyzer, is in the range of from 1.2 μm to 15 μm.

2. A silver powder as set forth in claim 1, wherein the ratio (SEM diameter/$D_{50}$ diameter) of an average particle diameter (SEM diameter) of single particles, which is measured by means of a field emission scanning electron microscope, to said particle diameter ($D_{50}$ diameter) corresponding to 50% of accumulation in volume-based cumulative distribution of the silver powder is in the range of from 0.3 to 1.0.

3. A silver powder as set forth in claim 1, wherein the ratio (tap density/$D_{50}$ diameter) of a tap density to said particle diameter ($D_{50}$ diameter) corresponding to 50% of accumulation in volume-based cumulative distribution of the silver powder is in the range of from 0.45 g/(cm$^3$ μm) to 3.0 g/(cm$^3$ μm).

4. A silver powder as set forth in claim 1, which has an oxygen content of not higher than 0.1% by weight.

5. A silver powder as set forth in claim 1, which has a BET specific surface area of 0.1 to 1.0 m$^2$/g.

6. A silver powder as set forth in claim 1, which has a tap density of 2 to 6 g/cm$^3$.

7. An electrically conductive paste comprising:

an organic component; and a silver powder as set forth in claim 1, the silver powder being dispersed in the organic component.

8. A method for producing an electrically conductive film, the method comprising the steps of:

applying an electrically conductive paste as set forth in claim 7, on a substrate; and burning the applied electrically conductive paste.

* * * * *